US005496104A

United States Patent [19]

Arnold et al.

[11] Patent Number: 5,496,104

[45] Date of Patent: Mar. 5, 1996

[54] OUTER DECORATIVE DOOR ASSEMBLY FOR DOMESTIC APPLIANCES

[75] Inventors: John E. S. Arnold, Rochester; Carl Adams, Eccles, both of United Kingdom

[73] Assignee: J.E.S. Arnold (Domestic Appliances) Limited, Rochester, England

[21] Appl. No.: 211,890

[22] PCT Filed: Oct. 16, 1992

[86] PCT No.: PCT/GB92/01896

§ 371 Date: Apr. 18, 1994

§ 102(e) Date: Apr. 18, 1994

[87] PCT Pub. No.: WO93/08323

PCT Pub. Date: Apr. 29, 1993

[30] Foreign Application Priority Data

Oct. 17, 1991 [GB] United Kingdom ..... 9122079

[51] Int. Cl.[6] ..... A47B 17/04

[52] U.S. Cl. ..... 312/204; 312/329; 16/DIG. 14

[58] Field of Search ..... 312/204, 228, 312/329; 16/223, 252, DIG. 14, 320, 382, 385; 248/206.5, 289.1; 40/600; 49/478.1

[56] References Cited

U.S. PATENT DOCUMENTS

| | | | |
|---|---|---|---|
| 2,624,909 | 1/1953 | Kujawa | 312/329 X |
| 3,294,461 | 12/1966 | Barnard et al. | 312/204 X |
| 3,367,730 | 2/1968 | Andrews et al. | 312/204 |
| 3,936,107 | 2/1976 | Gourdeau et al. | 312/204 X |
| 4,229,921 | 10/1980 | Schell | 312/204 X |
| 4,287,676 | 9/1981 | Weinhaus | 40/600 X |
| 4,788,964 | 12/1988 | Dorsey et al. | 16/D14 X |

FOREIGN PATENT DOCUMENTS

| | | | |
|---|---|---|---|
| 0012313 | 7/1980 | European Pat. Off. . | |
| 0046314 | 2/1982 | European Pat. Off. . | |
| 0047685 | 3/1982 | European Pat. Off. . | |
| 080770 | 6/1983 | European Pat. Off. . | |
| 0162028 | 4/1985 | European Pat. Off. . | |
| 0168672 | 4/1990 | European Pat. Off. . | |
| 1277373 | 10/1960 | France | 16/DIG. 14 |
| 2347963 | 4/1975 | Germany . | |
| 2050814 | 5/1980 | United Kingdom . | |
| 2079589 | 1/1982 | United Kingdom . | |
| 2114432 | 8/1983 | United Kingdom . | |
| 2238468 | 6/1991 | United Kingdom . | |

*Primary Examiner*—Peter M. Cuomo
*Assistant Examiner*—James O. Hansen
*Attorney, Agent, or Firm*—Birch, Stewart, Kolasch & Birch

[57] ABSTRACT

An apparatus for fitting a decorative door to an existing washing machine or other domestic electrical appliance, when it is desired, to match the appliance to the decorative theme/color scheme of a kitchen. The assembly includes an "L" shaped extruded aluminum plate which can be secured to a domestic appliance by means of rubber faced magnets. Hinges on the plate are adapted to receive a door to cover the appliance and match the same to the kitchen's decoration thus creating an "integrated" appliance.

22 Claims, 5 Drawing Sheets

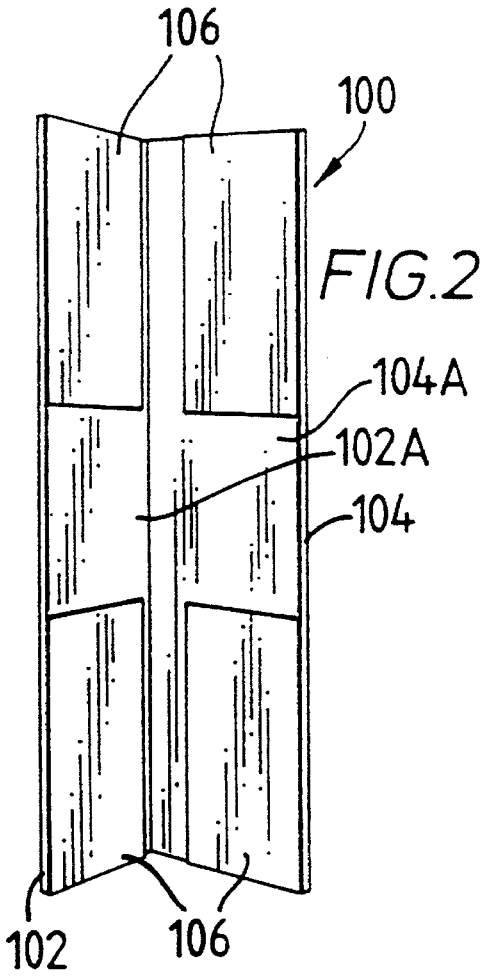
FIG.2
FIG.1
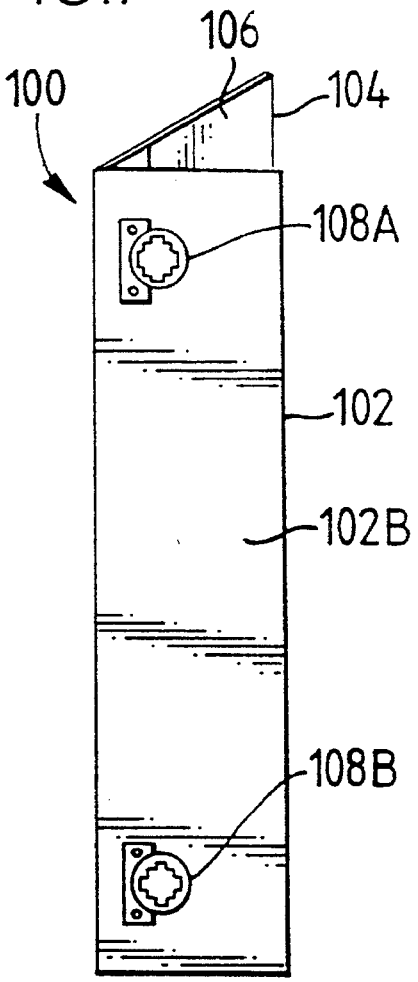
FIG. 10
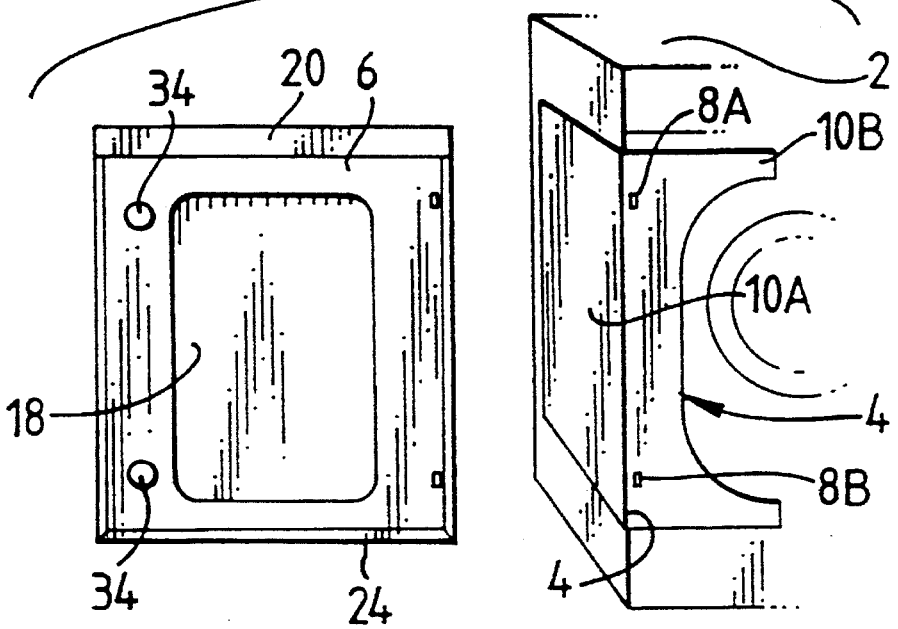

OUTER DECORATIVE DOOR ASSEMBLY FOR DOMESTIC APPLIANCES

BACKGROUND OF THE INVENTION

1. Field of the Invention

This invention relates to outer decorative door assemblies for domestic electrical appliances. The term domestic electrical appliances includes such items as refrigerators, washing machines, tumble dryers, dishwashers, spin dryers and the like.

2. Description of the Related Art

Most kitchens are equipped with several different domestic electrical appliances. Many modern kitchens are "fitted", that is to say they include a number of fitted cupboards, units, worktops and the like which are decorated or coordinated to provide a uniform decorative theme/color scheme. Wood panelling is one typical popular decorative theme. The matching of domestic appliances to fitted kitchens often causes problems because most existing domestic electrical appliances are finished in white painted or plastic coated steel. Unless the fitted kitchen itself is to be white the existing appliances will not match the kitchen's decorative theme (and if the decorative theme was white painted wood panelling the appliance would not properly match the decoration even then).

When fitting a new kitchen two options are available to obtain a uniform decorative theme which the kitchen's domestic appliances match. The kitchen's existing appliances can be built into units in the fitted kitchen: alternatively the existing appliances can be replaced with new "integrated" appliances, an "integrated" appliance being one which matches the kitchen's decorative theme.

The first option, that is building existing appliances into units, usually involves building a cupboard under a worktop into which the appliance is inserted. This is expensive and time consuming at the fitting stage. First, an extra cupboard is needed which adds to the expense of the fitted kitchen. Also, to enable the appliance to fit fully in the cupboard under the worktop a much wider worktop (usually 700 mm or more) is needed, than would normally be required with an integrated appliance. Further, the cupboard has to be sufficiently large to provide space on either side of the appliance. Also access to the appliance is awkward.

The second option, replacing the existing appliances with new integrated appliances which match the decoration of the kitchen is also expensive because it involves buying new appliances and discarding the existing appliances even though they may be perfectly servicable.

Various types of matched appliance exist. Some are painted in colours other than white: the majority include a panel, which is often made of wood, fitted to the door of the machine. A dishwashing machine having such a wood panelled door is disclosed in GB-A-2079589. EP-A-0080770 discloses a washing machine which has a fitted plastic door panel to which an (interchangeable) decorative panel is screwed.

However, whichever of the two options is chosen, buying integrated appliances, or building in the existing appliances, considerable expense is involved.

SUMMARY OF THE INVENTION

It is an object of the present invention to alleviate some or all of the above-mentioned problems.

Thus, according to a first aspect of the present invention, there is provided an assembly for attachment to a domestic appliance comprising:— a plate, which is provided with magnetic means for releasably securing the plate to the appliance; and hinge means mounted on the plate, said hinge means being adapted to receive a door or the like, the arrangement being such that the plate may be attached to a ferromagnetic domestic appliance and a door or the like may be secured to the hinge means to cover the front of the appliance.

Using the present invention a door (which matches a kitchen's decorative scheme), may be fitted to an existing domestic electrical appliance to enable the appliance to be matched to its surroundings. There is thus no requirement to either replace existing appliances.

The use of magnetic means enables the assembly to be easily fitted to a casing of domestic appliance without the need for tools and without drilling into or otherwise affecting the existing appliance and thus can avoid impinging on any manufacturer's warranties on that appliance. The door and assembly may be easily removed from the appliance for servicing and in the event that the appliance breaks down and needs replacing it is a simple matter to remove the assembly from the broken appliance and attach it to a replacement domestic appliance.

In a preferred embodiment, the plate is securable to the appliance by means of rubber faced magnets.

In one embodiment the plate is generally planar this type is suitable for fitting to a side of the casing of domestic appliances such as refrigerators and dishwashers which have doors forming their front faces to enable the weight of any decorative panel to be supported by the casing via the hinges and not by the appliance's door.

Alternatively it may be an "L" shaped cross section defining two perpendicular surfaces one of which is securable to a front face of an appliance the other of which fits to a side of the appliance.

The plate may be made of extruded aluminium.

The plate may have a white coated finish to match a white appliance.

The assembly may include a door ready mounted to the hinge means.

The door may include a decorative panel releasably secured to the door, the panel being removable for replacement by a different panel having a different decorative design.

Preferably the door includes a frame or trim which extends around the perimeter of the door and in which the decorative panel may be mounted by sliding to avoid the use of screws or tools.

The trim or frame may include a handle which is removable and interchangeable with the trim for the lowermost part of the door to enable the door to be reversable in orientation so it can be adjusted to fit a domestic appliance and open in either a left handed or a right handed manner.

The trim and panel may be supplied in a variety of colors to blend with the existing cosmetic colors of the appliance and kitchen units and fittings.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Specific embodiments of the invention will now be described, by way of example only, and with reference to the accompanying drawings in which:—

FIG. 1 is a perspective view of an assembly embodying the present invention;

FIG. 2 is a further perspective view of the assembly of FIG. 1;

FIG. 10 is a view of the washing machine and door assembly shown in FIG. 1, partly disassembled.

DESCRIPTION OF THE PREFERRED EMBODIMENTS

Figure 3:
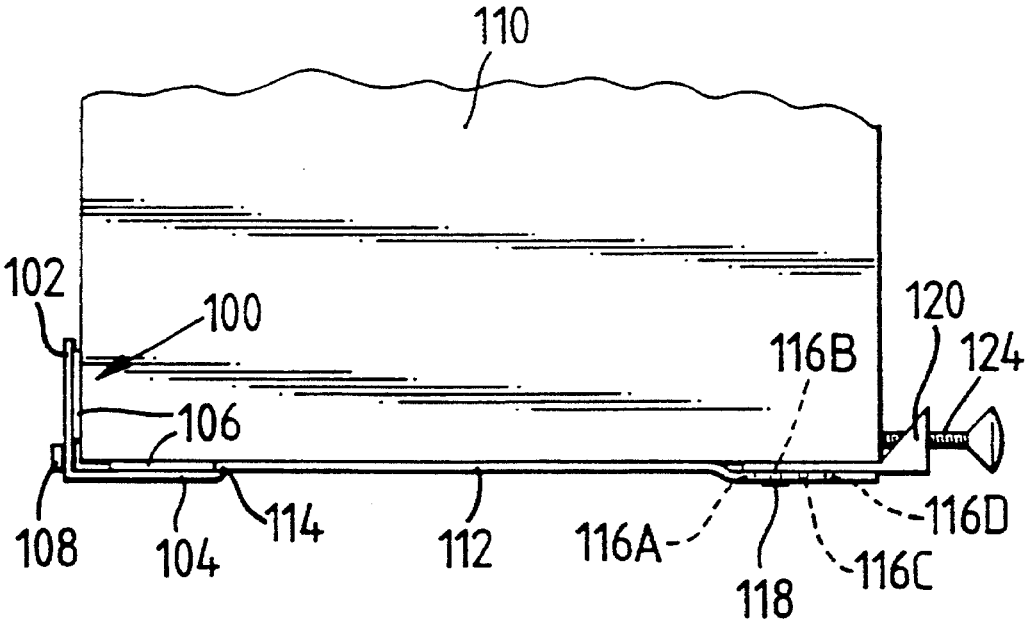
FIG. 3 is a plan view illustrating the use of a safety strap when the assembly of FIG. 1 is secured to a washing machine.

Referring to the drawings, FIG. 1 shows a right angled plate 100 having an "L" shaped cross section defining two perpendicular plates 102 and 104. The length of plate 100 is 450 mm. Plate 102 has a width of 100 mm: plate 104 has a width of 115 mm.

As seen in FIG. 2, the plates 102, 104, each carry two large rubber faces magnets 106. The magnets 106 are located on "facing" surfaces 102A and 104A of the plate 100 so that they can be used to secure the plate 100 to a right angled corner of a ferromagnetic object, that is a washing machine shown in FIG. 3.

As is best seen in FIG. 1, on the opposite face 102B of side 102 are upper and lower hinges 108A, 108B spaced 350 mm apart. The hinges are located approximately 50 mm from the top and bottom of the plate 102 respectively: they are standard face to face kitchen hinges.

FIG. 3 shows the plate assembly 100 in use attached to a corner of a washing machine 110: the washing machine has a steel casing/cabinet and because steel is ferromagnetic, the magnets will hold the plate to the washing machine. A door (not shown) can then be placed over the washing machine and fitted to the hinges in the appropriate place, either, in it's original place or after removing the magnetic plate from the washing machine. Since the plate assembly is held to the washing machine by means of magnet it is easy to adjust the position of the door by adjusting the location of the plate assembly. The weight of the door is supported by the casing/cabinet of the washing machine.

FIG. 3 also shows an optional safety assembly which helps prevent the plate becoming accidentally dislodged from the washing machine 110. The assembly comprises a torsion strap 112, one end 114 of which is attached to the plate 104 by means of a counter sunk screw or tape (not shown), the other end of the strap being attached by means of one 116B of a series 116A, B, C, D, of holes in the strap to a pin on a tensioning screw holder 120. The tensioning screw holder 120 fits on a rear corner of the washing machine cabinet and adjusting the tensioning screw 124 tensions the strap 112 to hold the plate 100 securely on the washer.

The right angled plate 100 is formed of aluminium which is extruded in the desired "L" shape. To receive the hinges, a hole is drilled in the aluminium plate and then the stainless steel bush is pressed into the aluminium, the bush being threaded so that the hinges 108A, 108B can be screwed against the plate.

The magnets 106 are permanent ferromagnets (to avoid deterioration with age or vibration), are mounted on 0.5 mm sheet steel to improve the magnetic strength and have a 2 mm rubber backing to prevent damage to the washing machine or the like which will also absorb some vibrations.

Figure 4:
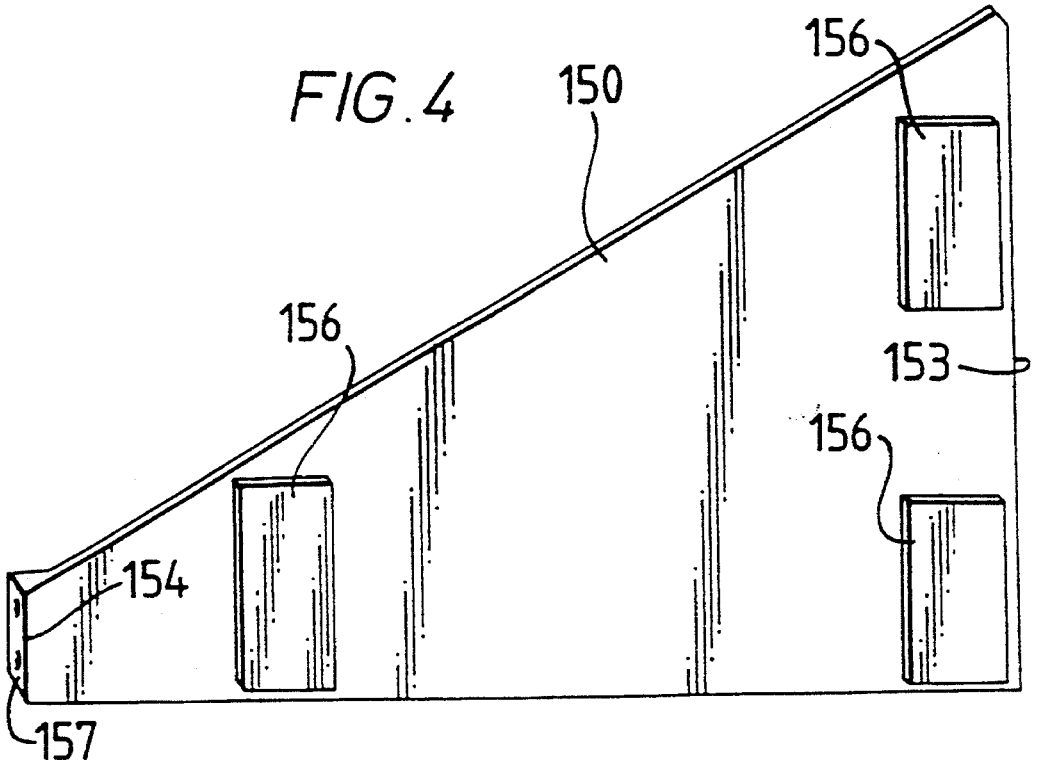
FIG. 4 shows a plate for attachment to dishwashers.

FIG. 4, shows a plate 150 for attaching a door (not shown) to the front of a dishwasher, (not shown). The plate is a right angled trapezium in shape. The base of the plate is 450 mm long, one of the parallel sides 153 of the trapezium is 300 mm long, the other side 154 is 120 mm long. Three rubber faced magnets 156, are secured to the plate.

At the shorter side 154 of the plate, the plate is much thicker being sufficiently thick to define a face 157 which is perpendicular to the general surface of the plate and to allow a hinge to be mounted to it on which a door can be mounted.

In use, the plate 150 is attached to one side of a front loading dishwasher, and a similar plate (not shown), being a mirror image of plate 150, is attached to the opposite side of the dishwasher by means of magnets 156. The longer sides 153 are located at the rear of the dishwasher. A wooden door (not shown) or the like is attached to the plates by means of the hinges on the faces 157. The wooden door is attached to the door of the dishwasher in such a manner as to allow relative movement between the two but with the weight of the wooden door supported by the plate and dishwasher casing to avoid strain being put on the dishwasher's door/door mounting.

Figure 5B:
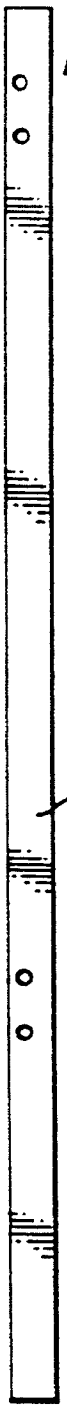
FIG. 5B is a side view of the plate of FIG. 5A.
Figure 5A:
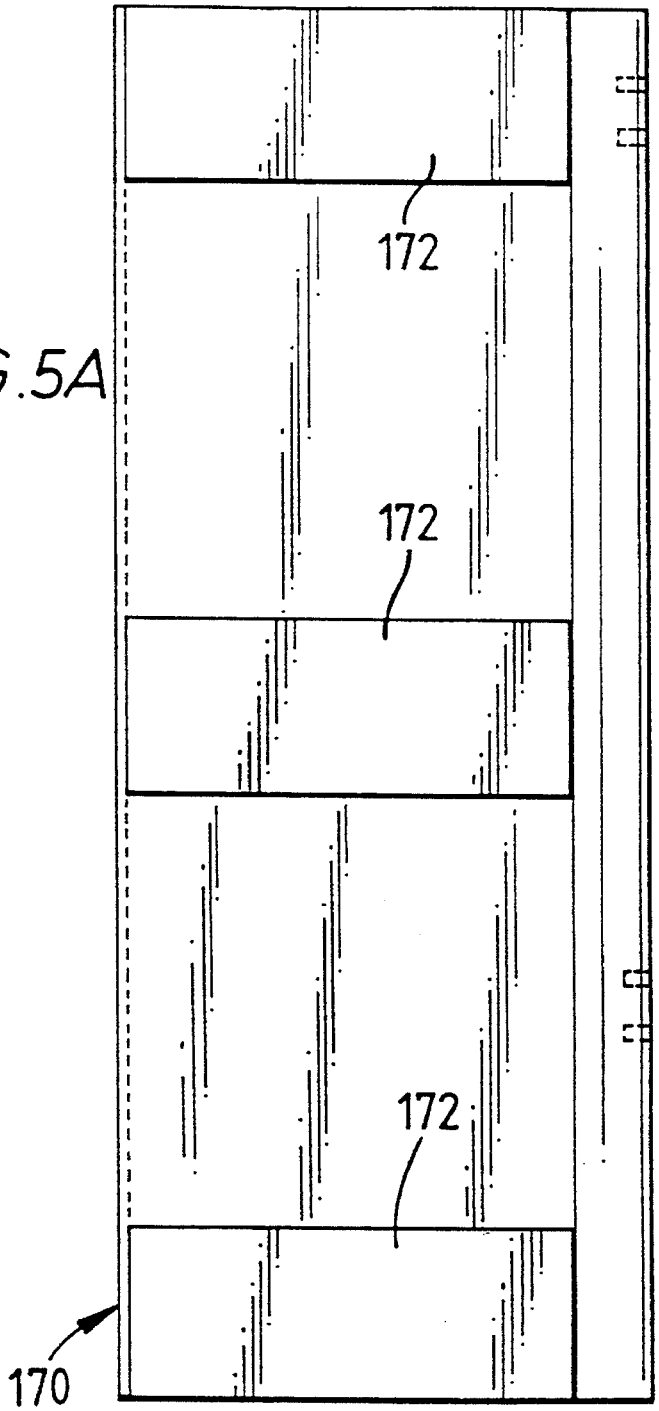
FIG. 5A is a plan view of a plate for attachment to fridges.
Figure 5C:
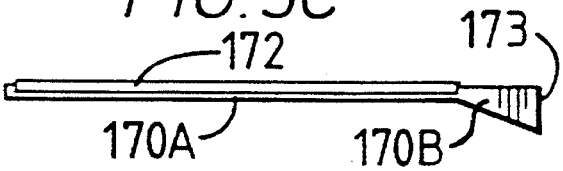
FIG. 5C is a front view of the plate of FIG. 5A.

Referring to FIGS. 5A, B and C, a rectangular plate 170, of sides 800 mm is shown. As is best seen in FIG. 5C, the plate comprises a thin generally planar portion 170A and a built-up portion 170B which is generally trapezoidal in cross section and which at its widest at one end is 20 mm thick and defines a face 173 which is perpendicular to the planar portion 170A, compared to the rest 170A of the plate which is between 2 and 3 mm thick. On one side of the planar portion 170A of the plate, there are three large magnetic pads, 172.

As is best seen in FIG. 5B, the plate has four holes drilled in the face 173 into which stainless steel threaded inserts are fitted to enable hinges, (not shown) to be fixed to the plate 170.

In use, the plate 170 is mounted to the side of the casing of a refrigerator to which the refrigerator door is hinged and a decorative door or wood panel or door is attached to the plate 170 via the hinges.

In order to enable the decorative door to open the refrigerator door when the same is opened, the refrigerator door handle is removed and a handle slider is mounted to the door in place of the handle, the handle slider comprising a protruding plate which fits, is held, and slides in a channel mounted on the back of the door panel, in a manner which is known in connection with integrated appliances.

Importantly, all the weight of the decorative door or wood panel, is carried by the plate and not by the refrigerator.

Figure 6:
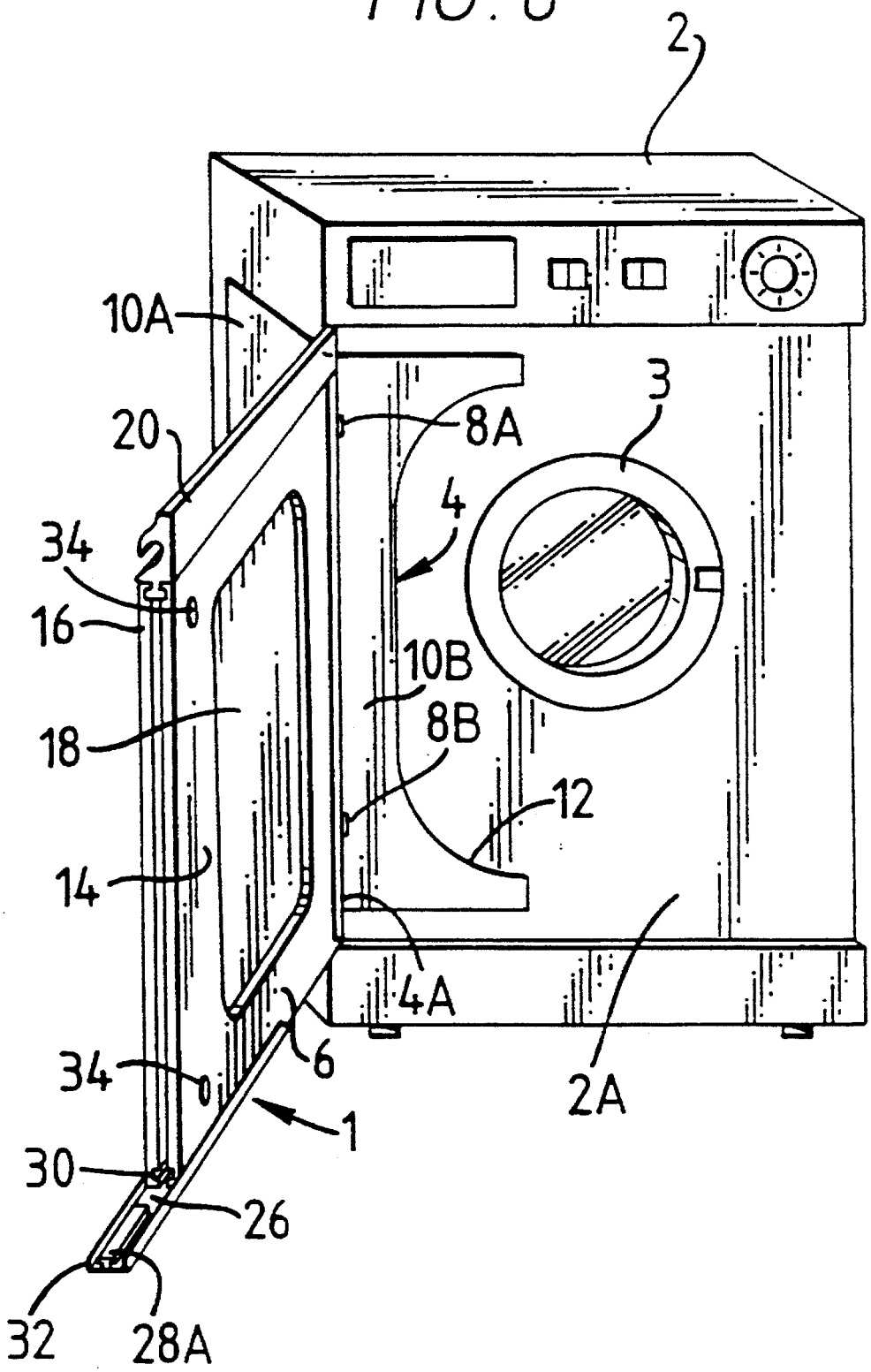
FIG. 6 is a perspective view of a washing machine to which a door assembly embodying the present invention has been attached.

FIG. 6 shows a door assembly, generally indicated at 1, attached to the front 2A of a front loading washing machine 2. The washing machine 2 has a round glass door 3 which projects from the front 2A of the machine. The door assembly 1 comprises a bent plate 4 on which a door 6 is mounted by means of two hinges, an upper hinge 8A and a lower hinge 8B, located adjacent the corner 4A of the plate.

The plate 4 is "L" shaped in cross section. It comprises a generally rectangular piece of material formed into two substantially perpendicular surfaces 10A, 10B joined at the corner 4A. Surface 10A is rectangular and fits along the side of the washing machine:, as shown in FIG. 10 surface 10B is generally rectangular but includes a generally semi-oval shaped cut out portion 12. As can be seen from FIG. 6 the semi-oval shaped cut out portion 12 prevents the plate impinging on the projecting glass door 3 when the plate 4 is fitted to the front of a front loading washing machine 2.

The plate 4 is made from a sheet of magnetic material covered with colored plastic to match surfaces 10A and 10B to the color of the appliance 2. This magnetic attraction between the plate and the metal front and one side of the washing machine secures the plate in place against the washing machine. An additional strong conventional magnet, not shown, may be added to the plate to increase the forces holding the plate to the machine, for safety reasons.

Figure 8:
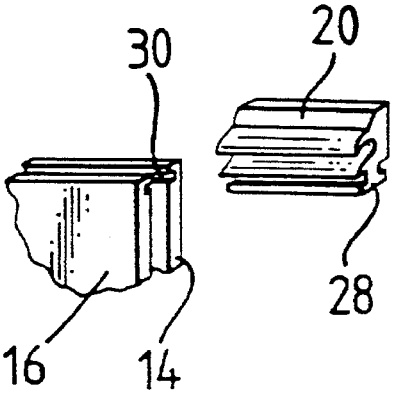
FIG. 8 show details of the handle on top of the frame.
Figure 9:
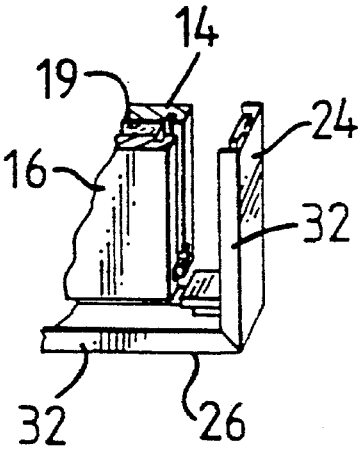
FIG. 9 show details of one corner of the frame of the door.

The door 6 comprises two plastic panels, an inner skin or panel 14 and an outer skin or panel 16 (See FIGS. 6, 8 and 9). A recess 18 which is adapted to receive the projecting door 3 of the washing machine when the door 6 is closed, is formed in the inner panel 14 as shown in FIG. 6. The outer panel 16 is flat. The outer panel 16 is glued to the base of the recess 18 of the inner panel 14. Apart from where the recess is glued to the outer panel, there is a space between the panels 16, 14. This space may be filled with a suitable material such as foam 19, as shown in FIG. 9.

Figure 7:
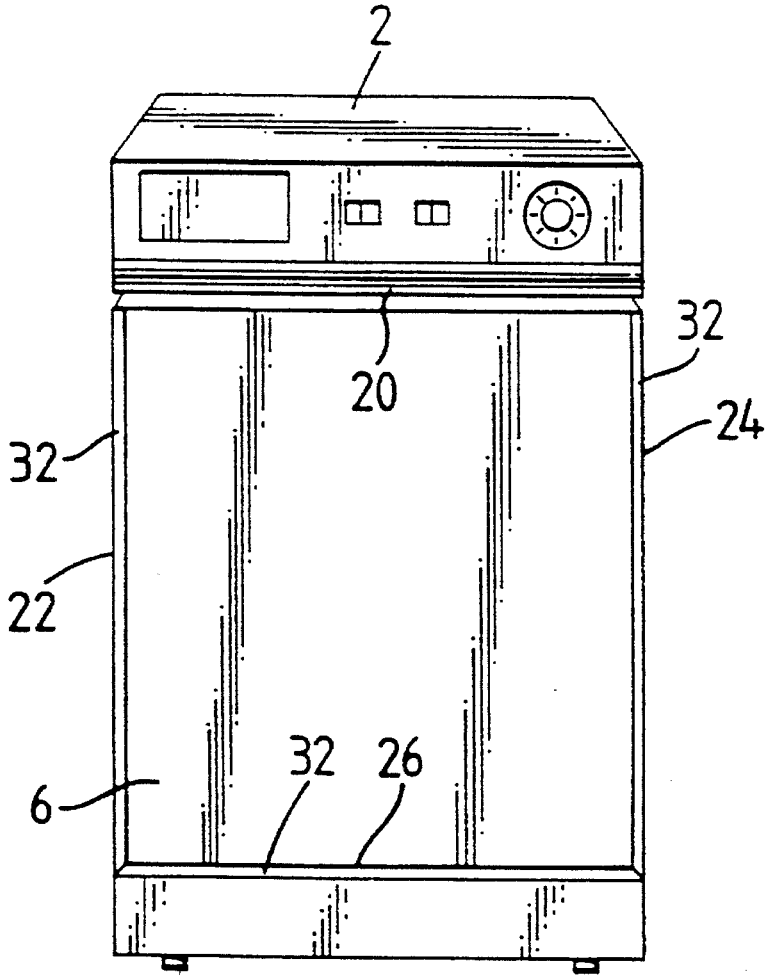
FIG. 7 is a view of the machine and door assembly shown in FIG. 1 with the door closed.

A trim, or frame, comprising a handle 20, side trims 22, 24 and base trim 26 are fitted around the perimeter of the door panels 14, 16, as shown in FIG. 7. The base of the handle 20 and base trim 26 may be formed with a "T" shaped projection 28 for sliding insertion into a corresponding shaped recess 30 in the door 6, as shown in FIG. 8. A similar arrangement may be used for the side trims 22, 24, as shown in FIG. 9.

The base trim 26 and handle 20 are interchangeable to enable the door assembly 1 to be fitted to an appliance in either a left handed or right handed manner by rotating the assembly through 180° and placing the plate 4 on the other side of the washing machine 2.

The side trims 22, 24, the handle 20 trim 26 defines walls 32 behind which the perimeter area of a decorative panel may be inserted so that it is held between the walls and the outer panel 16.

Two magnets 34 are provided on the door, as shown in FIG. 6 and 10 to form a catch when the door is shut.

The handle 20 and trim 22, 24, 26 are made of a plastics material.

The recess 18 and cut out portion 12 may be made sufficiently large to accomodate most makes of washing machine.

Although the description relates to a washing machine, the assembly may be used on any suitable domestic appliance.

The door assembly 1 will fit straight onto a domestic appliance without the need to drill holes in, or provide fixing means on, or alter the appliance itself.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An assembly for attachment to a domestic electrical appliance comprising:

a plate;

magnetic means for attaching the plate to the appliance;

a door including a decorative panel; and hinge means for mounting the door on the plate, where the plate is attachable to a ferromagnetic domestic appliance, weight of the door and decorative panel being supported on the appliance via the hinge means and plate, with the decorative panel being mounted on the door to provide the appliance with a desired external appearance.

2. The assembly as claimed in claim 1, wherein the plate defines two substantially perpendicular surfaces, one surface being securable to a front of the appliance and the other of the surfaces being securable to a side of the appliance.

3. The assembly as claimed in claim 2, wherein the magnetic means comprise rubber faces magnets.

4. The assembly as claimed in claim 2, wherein the plate is made from aluminum.

5. The assembly as claimed in claim 2, wherein the decorative panel is releasably secured to the door, the panel being removable for replacement by a different panel having a different decorative design.

6. The assembly as claimed in claim 5, wherein the door includes a frame which defines at least one recess in which edges of the decorative panel are slidable to mount the panel on the door.

7. The assembly as claimed in claim 6, wherein the frame defines a handle which is interchangeable with the frame for a lowermost part of the door to thereby enable the door to be reversible in orientation.

8. The assembly as claimed in claim 1, wherein the plate is generally planar and is securable to a side of the appliance.

9. The assembly as claimed in claim 8, wherein the plate is made from aluminum.

10. The assembly as claimed in claim 8, wherein the decorative panel is releasably secured to the door, the panel being removable for replacement by a different panel having a different decorative design.

11. The assembly as claimed in claim 10, wherein the door includes a frame which defines at least one recess in which edges of the decorative panel are slidable to mount the panel on the door.

12. The assembly as claimed in claim 11, wherein the frame defines a handle which is interchangeable with the frame for a lowermost part of the door to thereby enable the door to be reversible in orientation.

13. The assembly as claimed in claim 11, further including a safety strap attached to the plate securable on the appliance and tensionable to improve security of the fixing of the plate to the appliance.

14. The assembly as claimed in claim 11, wherein the plate is a right angled plate for attachment to a front and one side of the appliance.

15. The assembly as claimed in claim 11, wherein the decorative panel is adapted to cover a majority of a vertical face of the appliance when providing the appliance with the desired external appearance.

16. A domestic appliance comprising:

a casing for the domestic appliance, the casing including ferromagnetic material;

an attachment assembly comprising:

a plate;

magnetic means for attaching the plate to the appliance;

a door including a decorative panel; and hinge means for mounting the door on the plate, wherein the plate is attachable to the ferromagnetic material of the casing;

weight of the door and decorative panel being supported on the casing via the hinge means and plate, with the decorative panel being mounted on the door to provide the appliance with a desired external appearance.

17. The appliance as claimed in claim 6, wherein the plate is generally planar and is fitted to a side of the appliance.

18. The appliance as claimed in claim 17, wherein two plates are provided, the appliance having two sides with each side having one of the plates fitted thereon.

19. The appliance as claimed in claim 16, wherein the plate is a right angled plate which fits to a front and one side of the appliance.

20. The appliance as claimed in claim 16, wherein two plates are provided, the appliance having two sides with each side having one of the plates fitted thereon.

21. The appliance as claimed in claim 16, further including a safety strap attached to the plate securable on the appliance and tensionable to improve security of the fixing of the plate to the appliance.

22. The appliance as claimed in claim 16, wherein the appliance has a vertical face and wherein the decorative panel covers a majority of the vertical face of the appliance when providing the appliance with the desired external appearance.

* * * * *